US006062984A

United States Patent [19]

Ju

[11] Patent Number: 6,062,984

[45] Date of Patent: May 16, 2000

[54] GOLF PUTTING TRAINING APPARATUS

[76] Inventor: Ji-Yong Ju, 344, Dae Jin APT., 741-3, Kupo 2-dong, Puk-ku, Pusan, Rep. of Korea

[21] Appl. No.: 09/223,382

[22] Filed: Dec. 30, 1998

[30] Foreign Application Priority Data

Dec. 31, 1997 [KR] Rep. of Korea ..... 97-45714

[51] Int. Cl.[7] ..... A63B 69/36

[52] U.S. Cl. ..... 473/160

[58] Field of Search ..... 473/160, 161, 473/278, 279

[56] References Cited

U.S. PATENT DOCUMENTS

| | | | |
|---|---|---|---|
| 1,612,291 | 12/1926 | Jackson | 473/160 |
| 2,678,823 | 5/1954 | Hugman | 473/160 |
| 3,430,964 | 3/1969 | Budzinski | 473/279 |
| 3,601,407 | 8/1971 | Lorrance | 473/160 |
| 3,897,067 | 7/1975 | Smith | 473/160 |
| 4,222,568 | 9/1980 | Russo | 473/160 |
| 4,240,637 | 12/1980 | Cross et al. | 473/160 |
| 5,445,381 | 8/1995 | Van Ert | 473/160 |
| 5,863,256 | 1/1999 | MacLean et al. | 473/160 |

*Primary Examiner*—Mark S. Graham

*Attorney, Agent, or Firm*—Jacobson, Price, Holman & Stern, PLLC

[57] ABSTRACT

A golf putting training apparatus for allowing for putting stroke practice at a wide variety of angles is provided, which includes: apertures formed at opposite sides of one end of the plate body, where the cup is mounted, and at center of the other end of the plate body; caps fixed into the apertures, which mate with wrench insertion holes in artificial grass; and height adjusters installed in the caps, the height adjusters each including: a fixed tube body; a plurality of spiral tube bodies for height adjustment, which thread onto the fixed tube body; and a pointed earth spiral bar which threads onto a lowermost spiral tube body having a wrench groove therein, the earth spiral bar and the spiral tube bodies for height adjustment having arc-shaped projections on their respective tops, and the projections and the fixed tube body respectively having stoppers therein, by which the projections are stopped.

1 Claim, 3 Drawing Sheets

GOLF PUTTING TRAINING APPARATUS

BACKGROUND OF THE INVENTION

1. Field of the Invention

The present invention relates to a golf putting training apparatus for permitting an individual to practice putting at a wide variety of angles.

2. Description of the Related Art

A conventional putting training apparatus is constructed such that a grass-grown plate body includes a hole on its slightly raised end. Therefore, it is merely training for putting on a plane surface of the ground.

Since a putting green is formed, sloping to a plane, however, the monotonous practice on a plane by the conventional putting training apparatus, cannot help golfers when playing the game of golf.

SUMMARY OF THE INVENTION

Accordingly, the present invention is directed to a golf putting training apparatus that substantially obviates one or more of the limitations and disadvantages of the related art.

An object of the present invention is to provide a golf putting training apparatus, in which a plate body covered with artificial grass, employs a height adjuster comprising a plurality of spiral tube bodies, at center of its one end and at opposite sides of the other end, so as to be inclined in every direction.

Additional features and advantages of the invention will be set forth in the description which follows, and in part will be apparent from the description, or may be learned by practice of the invention. The objectives and other advantages of the invention will be realized and attained by the structure as illustrated in the written description and claims hereof, as well as the appended drawings.

To achieve these and other advantages, and in accordance with the purpose of the present invention as embodied and broadly described, the golf putting training apparatus which is formed of a plate body 2 covered with artificial grass 1, with a cup 4 passing through a hole 3 made at its one end, comprises: apertures 5 formed at opposite sides of one end of the plate body 2, where the cup 4 is mounted, and at center of the other end of the plate body 2; caps 8 fixed into the apertures 5, after passing through central holes 7 that mate with wrench insertion holes 6 of the artificial grass 1; and height adjusters 20 installed in the caps 3, the height adjusters each including a fixed tube body 9, a plurality of spiral tube bodies 10 and 10' for height adjustment, and a pointed earth spiral bar 12 that threads onto a lowermost spiral tube body 10' having a wrench groove 11 therein, wherein arc-shaped projections 13 and 13' are formed on tops of the earth spiral bar 12 and the spiral tube bodies 10 and 10' for height adjustment, respectively, and stoppers 14 for stopping the projections 13 and 13' are formed inside the projections 13 and 13' and the fixed tube body 9, respectively, such that the earth spiral bar 12 and the spiral tube bodies 10 and 10' for height adjustment thread onto each other by rotation of a wrench 15 inserted into the wrench groove 11.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENT

Reference will now be made in detail to the preferred embodiments of the present invention, examples of which are illustrated in the accompanying drawings.

Figure 1A:
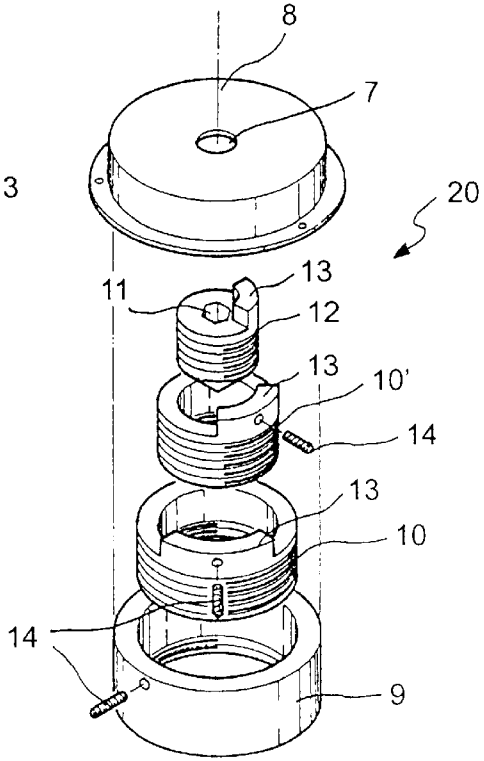
FIG. 1 is a perspective view of putting plate and artificial grass and FIG. 1A is an exploded, perspective view of a golf putting training apparatus height adjuster.
Figure 1:
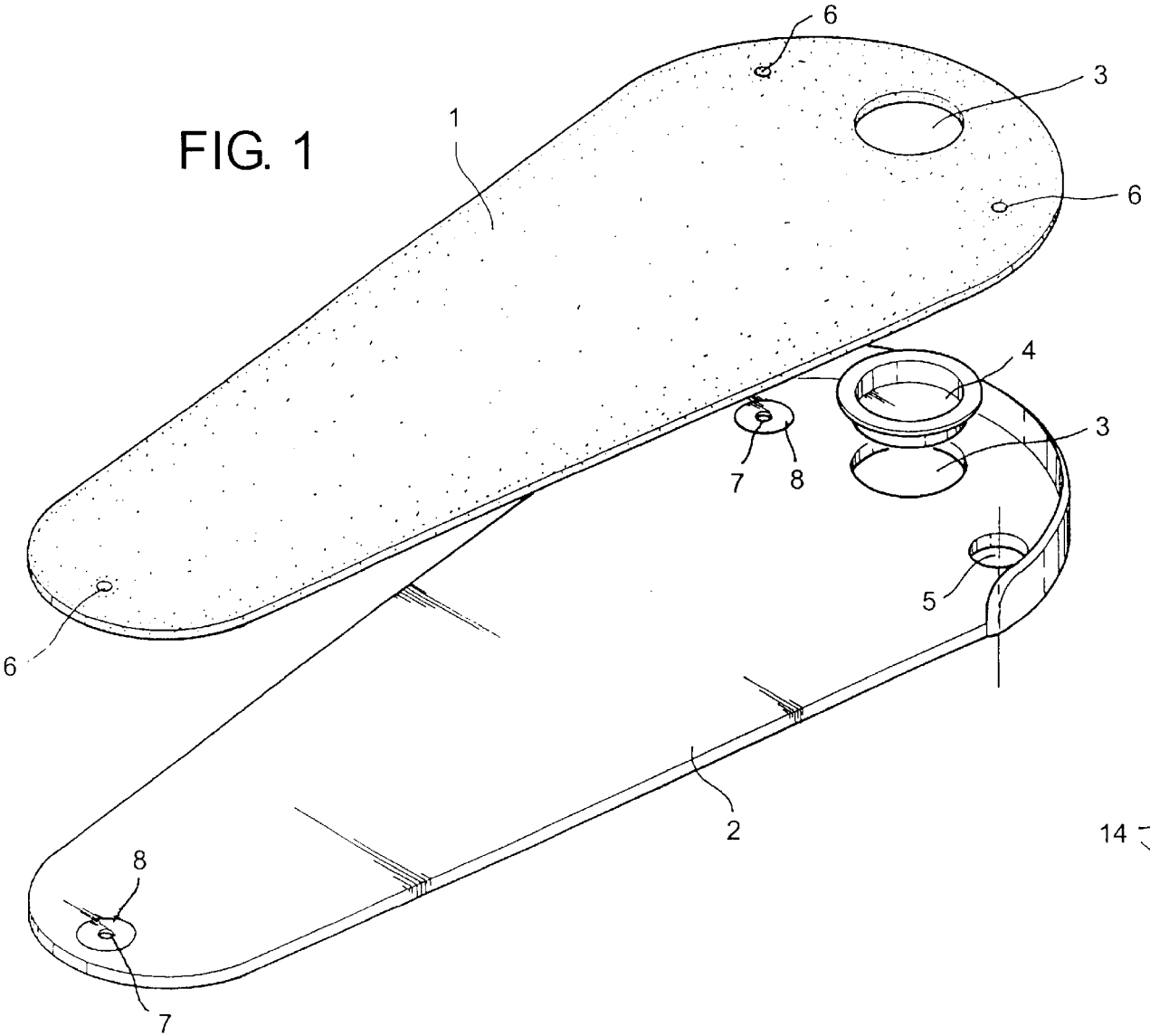
Figure 2:
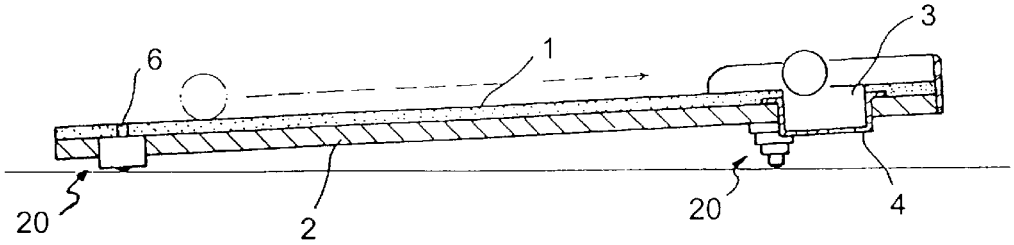
FIG. 2 is a side view of a state in which a preferred embodiment of the present invention is used.

Two height adjusters 20 fixed in caps 8 are mounted on both sides of cup 4, and one height adjuster is mounted at center of opposite side of cup 4, so that golfers can practice putting on a plane surface by uniformly adjusting the three height adjusters 20. As shown in FIG. 2, in case of practicing of a putting stroke on an upward slope, the two height adjusters 20 on both sides of cup 4 are adjusted to be higher than the height adjuster 20 opposite them, allowing plate body 2 to slope upwardly.

Figure 3A:
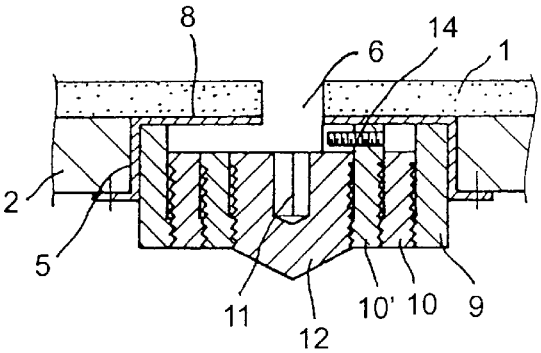
FIG. 3(A) is a cross-sectional view of a state in which a spiral tube body of a height adjuster is collapsed.
Figure 3B:
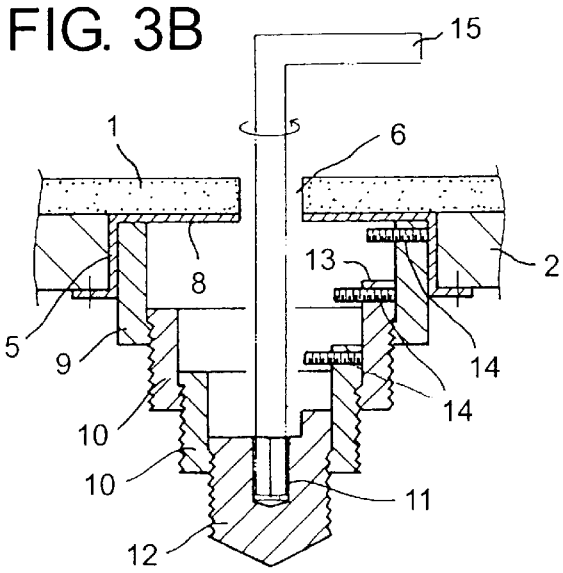
FIG. 3(B) is a cross-sectional view of a state in which a spiral tube body of a height adjuster is expanded.

As depicted in FIG. 3A, in heightening the height adjusters 20, spiral tube bodies 10 and 10' for height adjustment and earth spiral bar 12, fit into fixed tube body 9, while wrench 15 is received into wrench groove 11 formed at center of earth spiral bar 12, through wrench insertion holes 6 formed on artificial grass 1 and plate body 2, to be rotated in the direction of loosening earth spiral bar 12. Therefore, the earth spiral bar 12 is lowered and stops being rotated, permitting spiral tube body 10' outside the earth spiral bar 12 to turn to be unfastened. When the spiral tube body 10' does not turn any more, spiral tube body 10 larger in diameter than the spiral tube body 10' is loosened and falls integrally with spiral tube body 10' and earth spiral bar 12, from fixed tube body 9 having the largest diameter, mounted within cap 8. As depicted in FIG. 3(B), therefore, the height adjusters are elongated to set up their height. The height is adjusted depending on how earth spiral bar 12 and spiral tube bodies 10 and 10' are unfastened.

In order to lower the height adjusters 20 in the state of FIG. 3(B), wrench 15 is rotated in the direction of fastening earth spiral bar 12, in an opposite way to heighten the height adjusters 20 by inserting wrench 15 into wrench groove 11 of earth spiral bar 12. As a result, the earth spiral bar 12 is inserted and superimposed onto spiral tube body 10' for height adjustment. When projection 13 formed on top of earth spiral bar 12 is stopped by stopper 14 attached inside projection 13 of spiral tube body 10', it is rotated integrally with spiral tube body 10' before received into outermost spiral tube body 10. Subsequently, when projection 13 formed on top of spiral tube body 10' is stopped by stopper 14 of spiral tube body 10, it is rotated integrally with spiral tube body 10 before received into fixed tube body 9. Thereafter, when projection 13 formed on top of spiral tube body 10 is stopped by stopper 14 attached inside fixed tube body 9 that is fixed in cap 8, spiral tube body 10 is not rotated any more, and earth spiral bar 12 and spiral tube bodies 10 and 10' are completely accepted into fixed tube body 10, to be superimposed on one another. As shown in FIG. 3A, therefore, the height adjusters 20 are adjusted to be lowered.

Figure 4:
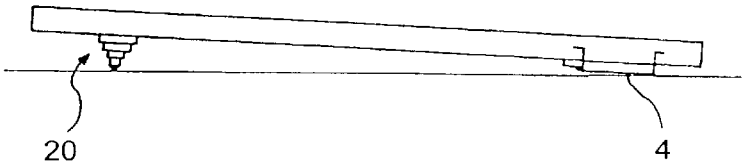
FIGS. 4 to 6 are side views of a state in which another preferred embodiment of the present invention is used.
Figure 5:
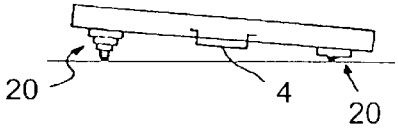
Figure 6:
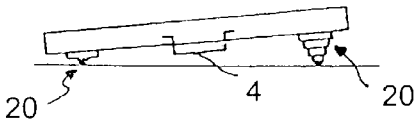
Figure 7:
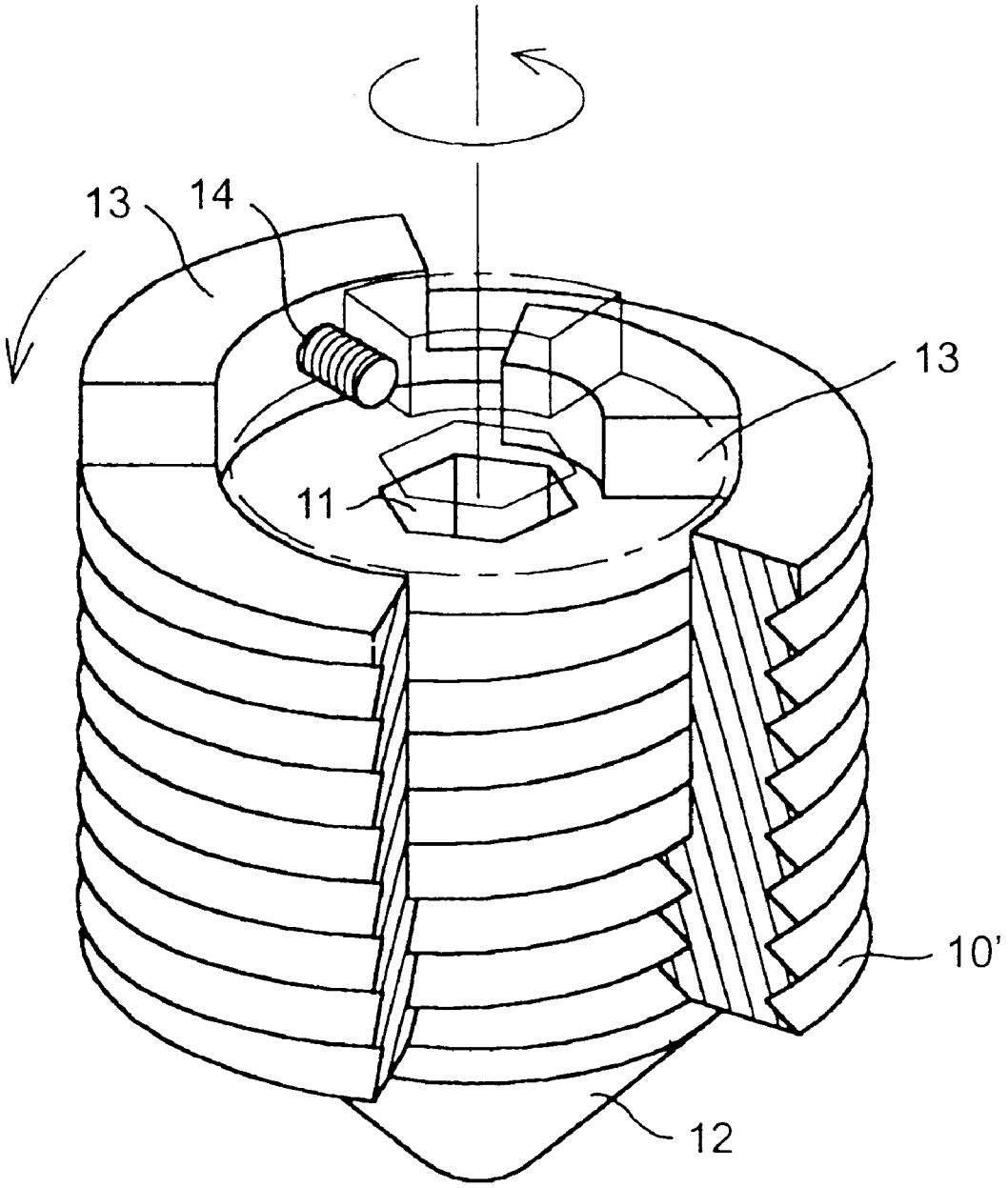
FIG. 7 is a partially broken view of a state in which a spiral tube body of a height adjuster operates.

A grade of plate body 2 is adjusted in the above-mentioned way. For example, in case of practicing of putting on a downward slope, as depicted in FIG. 4, the height adjuster 20 mounted opposite cup 4 is adjusted to be higher than two height adjusters 20 on both sides of cup 4. In case of putting practice on a lateral slope, two height adjusters 20 on both sides of cup 4 are adjusted to be different in height, and the height adjuster 20 opposite the two height adjusters 20 is also adjusted to have a proper height, as shown in FIGS. 5 and 6. In this connection, golfers are able to practice the putting stroke as if they played the game on a putting green.

As described above, the golf putting training apparatus of the present invention is freely adjusted to allow for the putting stroke practice on upward and downward slopes, on a lateral slope as well as on a plane surface. The apparatus will enable the golfers to learn a putting stroke effectively and make them proficient in golf.

It will be apparent to those skilled in the art that various modifications and variations can be made in the golf putting training apparatus of the present invention without deviating from the spirit or scope of the invention. Thus, it is intended that the present invention cover the modifications and variations of this invention provided they come within the scope of the appended claims and their equivalents.

What is claimed is:

1. A golf putting training apparatus that is formed of a plate body covered with artificial grass, with a cup passing through a hole made at one end, comprising:

apertures formed at opposite sides of the one end of the plate body where the cup is mounted, and at a center of the other end of the plate body;

caps fixed into the apertures, which mate with wrench insertion holes in the artificial grass; and height adjusters installed in the caps, the height adjusters each including: a fixed tube body; a plurality of spiral tube bodies for height adjustment, which thread onto the fixed tube body; and a pointed earth spiral bar which threads onto a lowermost spiral tube body having a wrench groove therein, the earth spiral bar and the spiral tube bodies for height adjustment having arc-shaped projections on respective tops, thereof and the projections and the fixed tube body respectively having stoppers therein, by which the projections are stopped.

* * * * *